US006891516B1

(12) United States Patent
Saunders et al.

(10) Patent No.: US 6,891,516 B1
(45) Date of Patent: May 10, 2005

(54) ADAPTIVE MULTIFILAR ANTENNA

(75) Inventors: Simon Reza Saunders, Ash (GB); Andreas-Albertos Agius, Patras (GR); Stephen Leach, Camberley (GB)

(73) Assignee: University of Surrey, Surrey (GB)

( * ) Notice: Subject to any disclaimer, the term of this patent is extended or adjusted under 35 U.S.C. 154(b) by 235 days.

(21) Appl. No.: 10/070,469

(22) PCT Filed: Sep. 1, 2000

(86) PCT No.: PCT/GB00/03368

§ 371 (c)(1),
(2), (4) Date: May 21, 2002

(87) PCT Pub. No.: WO01/18908

PCT Pub. Date: Mar. 15, 2001

(30) Foreign Application Priority Data

Sep. 9, 1999 (GB) ..... 9921363

(51) Int. Cl.[7] ..... H01Q 1/36
(52) U.S. Cl. ..... 343/895; 343/850; 343/876
(58) Field of Search ..... 343/700 MS, 850, 343/876, 895, 893

(56) References Cited

U.S. PATENT DOCUMENTS

| | | | | |
|---|---|---|---|---|
| 4,554,554 A | | 11/1985 | Olesen et al. | |
| 5,124,711 A | | 6/1992 | Sorais et al. | |
| 5,255,005 A | | 10/1993 | Terret et al. | |
| 5,600,341 A | | 2/1997 | Thill et al. | |
| 5,606,332 A | | 2/1997 | Darden, IV et al. | |
| 5,612,707 A | * | 3/1997 | Vaughan et al. | 343/895 |
| 5,635,945 A | | 6/1997 | McConnell et al. | |
| 5,708,448 A | * | 1/1998 | Wallace | 343/895 |
| 5,828,348 A | * | 10/1998 | Tassoudji et al. | 343/895 |
| 5,896,113 A | | 4/1999 | O'Neill, Jr. | |
| 5,920,292 A | | 7/1999 | O'Neill, Jr. | |
| 5,986,616 A | * | 11/1999 | Edvardsson | 343/853 |
| 6,278,414 B1 | * | 8/2001 | Filipovic | 343/895 |

FOREIGN PATENT DOCUMENTS

| | | |
|---|---|---|
| EP | 0 715 369 A1 | 6/1996 |
| EP | 0 767 508 A2 | 4/1997 |
| EP | 0 932 220 A2 | 7/1999 |
| WO | WO 97/11507 A1 | 3/1997 |
| WO | WO 99/41803 A1 | 8/1999 |

OTHER PUBLICATIONS

Kilgus, "Multielement, Frantional Turn Helices," *IEEE Transactions on Antenna and Propagation*, AP–16, pp. 499–500 (Jul. 1968).

(Continued)

*Primary Examiner*—Shih-Chao Chen
(74) *Attorney, Agent, or Firm*—Leydig, Voit & Mayer, Ltd.

(57) ABSTRACT

A multifilar antenna comprises n spaced antenna filaments, where n is an integer greater than 1; a matching circuit for matching the characteristic impedance of the antenna to that of a transmitting and/or receiving apparatus; a weighting circuit for applying gain and phase adjustments to signals passed to or from the n filaments; switch means associated with at least some of the filaments for selectively altering the electrical length and/or interconnections for the filaments; means for detecting electrical properties of the multifilar antenna with respect to the frequency, polarization and/or direction of propagation of a signal to be received or transmitted by the multifilar antenna and/or impedance matching of the antenna; and control means, responsive to the detecting means, for controlling the operation of the matching circuit, the weighting circuit and the switch means to adjust the properties of the multifilar antenna to suit better a current signal to be received or transmitted.

24 Claims, 6 Drawing Sheets

OTHER PUBLICATIONS

Kilgus, "Resonant Quadrifilar Helix," *IEE Transactions on Antenna and Propagation*, AP–17, pp. 349–351 (May 1969).
Kilgus, "Resonant Quadrifilar Helix Design," *The Microwave Journal*, pp. 49–53 (Dec. 1970).
Kilgus, "Shaped–Conical Radiation Pattern Performance of the Backfire Quadrifilar Helix," *IEEE Transactions on Antenna and Propagation*, pp. 391–397 (May 1975).
Egashira et al., "A Design of AM/FM Mobile Telephone Triband Antenna," *IEEE Transactions on Antennas and Propagation*, 42:4, pp. 538–540 (Apr. 1994).
Saunders et al., "Quadrifilar Helical Antenna (QHA) Characteristics of a Proposed Wire Antenna for an SPCN Handheld Terminal," Int'l Workshop of Mobile Communications, pp. 35–40 (Sep. 1996).
Agius et al., "Antenna Design for the ICO Handheld Terminal," 10th In'l Conf. on Antennas and Propagation, 436, pp. 1385–1389 (Apr. 1997).
Agius et al., "Intelligent Antennas for Mobile Handsets," 1st Surry Symp. on Intelligent Antenna Technology for Mobile Commn. (Aug. 1997).

* cited by examiner

ADAPTIVE MULTIFILAR ANTENNA

FIELD OF THE INVENTION

This invention relates to adaptive multifilar antennas.

BACKGROUND OF THE INVENTION

In fields such as mobile telephony and communication, it is being proposed that radio frequency transceivers operating in different frequency bands, and providing different services, should be integrated into single consumer devices.

For example, in order to improve the coverage area in which a mobile telephone can be used, a satellite system transceiver, a terrestrial transceiver and a domestic cordless telephone transceiver might be integrated into one hand-held unit. An alternative example is a dual service telephone operating at 1800 MHz in the user's home country but having the capability of operating at 900 MHz in other countries under a so-called roaming arrangement.

The electronics needed to achieve this aim are rapidly becoming smaller and lighter. A remaining problem area for multi-frequency, multi-system operation, however, is the antenna.

In order to operate as described above, an antenna should be able to work at different frequencies and with different types of base station. For example, one service may use terrestrial base stations and another may use orbiting satellites. This means that if the handset antenna is typically used in a vertical position (with the handset held next to the user's head) then for one service the antenna should have a radiation pattern substantially omnidirectional in azimuth and for the other service it should have an approximately hemispherical radiation pattern.

SUMMARY OF THE INVENTION

To cater for the different pattern and frequencies in use, it has been proposed to employ at least two distinct antennas within a common volute.

In a first aspect, the invention provides an adaptive multifilar antenna comprising:

n spaced filaments, where n is an integer greater than 1;

at least one filament group having a predetermined plurality of the filaments coupled together in a fixed phase relationship;

a weighting circuit operable to apply phase adjustments to signals passed to and/or from the n filaments and/or filament group;

detecting means operable to detect at least one electrical property of the multifilar antenna with respect to the frequency, polarisation and/or direction of propagation of a signal to be received or transmitted by the multifilar antenna and/or impedance matching of the antenna; and control means, responsive to the detecting means, operable to control the operation of the weighting circuit to adjust the properties of the multifilar antenna to suit better a current signal to be received or transmitted.

In another aspect, this invention also provides an adaptive multifilar antenna comprising:

n spaced antenna filaments, where n is an integer greater than 1;

at least one filament group having a predetermined plurality of the filaments coupled together in a fixed phase relationship;

a matching circuit for matching the characteristic impedance of the antenna to that of a transmitting and/or receiving apparatus;

a phasing circuit for applying respective gain and phase adjustments to signals passed to and/or from the n filaments and/or filament group;

switch means associated with each filament for selectively altering the electrical length and/or interconnections of the filaments;

means for detecting electrical properties of the multifilar antenna with respect to the frequency, polarisation and/or direction of propagation of a signal to be received or transmitted by the multifilar antenna and/or impedance matching of the antenna; and control means, responsive to the detecting means, for controlling the operation of the matching circuit, the phasing circuit and the switch means to adjust the properties of the multifilar antenna to suit better a current signal to be received or transmitted.

In the invention, the phase and/or gain relationships for signals from individual filaments of a multifilar antenna, and optionally also with the electrical length and/or interconnection pattern of the filaments, can be varied automatically in order to improve (or possibly to optimise, within the resolution of the adjustment system) the properties of the antenna for a particular signal to be received or transmitted. The automatic variation may be applied identically to predetermined groups of individual filaments.

For example, in embodiments of the invention, at least one of the above parameters could be varied to provide the best received signal level, the best signal to noise ratio, or the best signal to (noise plus interference) ratio and/or the best VSWR.

The adjustments will generally lead to a change in the antenna's frequency response and radiation pattern (shape and polarisation). It may not matter to the adjustment system what that change is quantitatively; the system may simply measure the output and make adjustments so as to improve the handling of the current signal.

BRIEF DESCRIPTION OF THE DRAWINGS

The invention will now be described by way of example with reference to the accompanying drawings, throughout which like parts are referred to by like references, and in which.

DETAILED DESCRIPTION OF THE INVENTION

Figure 1:
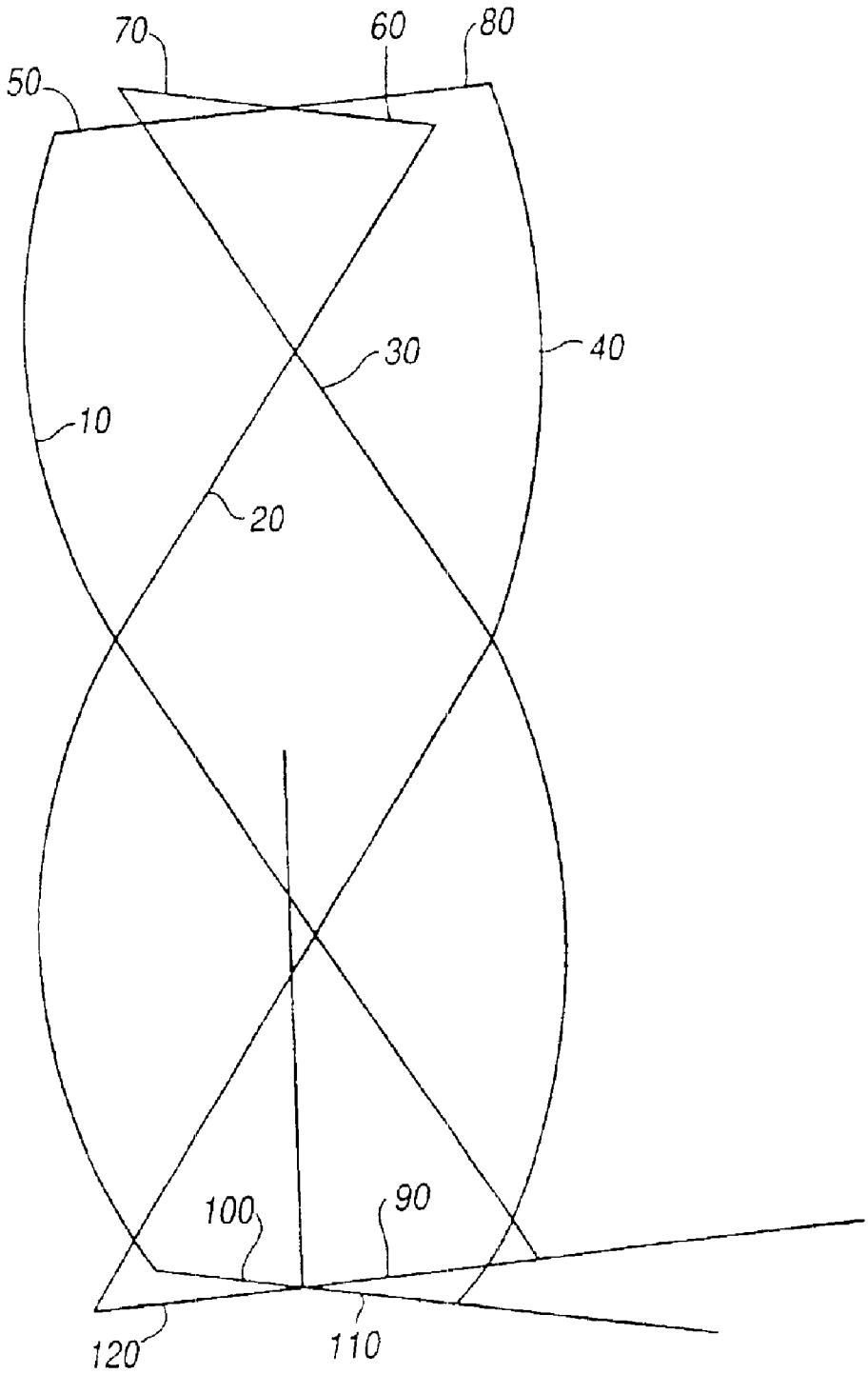
FIG. 1 is a schematic diagram of a quadrifilar helical antenna (QHA)

With reference to FIG. 1, a QHA comprises four helical elements 10 . . . 40 and eight radial elements 50 . . . 120. (In other embodiments six, for example, angularly spaced helical elements could be used). It will also be noted that not all the radial elements 50 . . . 120 will be present in all antenna configurations.

The helical elements are intertwined as shown in FIG. 1, and are disposed about a longitudinal axis of the antenna by 90° with respect to one another. Four of the radials 50 . . . 80 are disposed on the top and four 90 . . . 120 on the bottom of the volute, connecting the helical elements and forming two bifilar loops. The antenna is fed on one set of radials 90, 110 with 90° phase difference between the two feeds.

The radials 50 . . . 80 at the top end of the antenna with respect to the feeds (which in this example are at the bottom) may be shorted in pairs or may be open-circuit depending on the resonant length of the helical elements and the required response.

The QHA is described in the following references:

[1] Kilgus C. C., "Multielement, Fractional Turn Helices", IEEE Transactions on Antenna and Propagation, Vol.AP-16, pp. 499–500, July 1968

[2] Kilgus C. C., "Resonant Quadrifilar Helix", IEEE Transactions on Antenna and Propagation, Vol.AP-17, pp. 349–351, May 1969

[3] Kilgus C. C., "Resonant Quadrifilar Helix Design", The Microwave Journal, December 1970.

The antenna's radiation pattern mode (hemispherical or other) depends on the phase combination used on the two or four feeds. The exact shape of the antenna's radiation pattern in each mode depends on the pitch and dimensions of the helices. In the axial mode it has a shape varying from hemispherical to cardioid depending on the dimensions of the structure. The polarisation is circular with a very good axial ratio inside the 3 dB angle.

In other embodiments, the multifilar antenna arrangement can also be used for diversity purposes. The different filaments can be used to provide space diversity between generally uncorrelated received signals. The effect of weighting the gain and/or phase can affect both the shape and the polarisation of the radiation pattern. This effect can benefit the transceiver in two ways. Firstly, the pattern shape and the polarisation are matching the direction and the polarisation of the incoming signal to try to optimise or improve the criterion ratio (S/N or S/(N+I), and secondly the structure can be used for polarisation diversity using the resulting pattern of different filaments or pairs of filaments.

FIG. 1 shows an antenna which has a generally cylindrical volute (i.e. circular in plan). Other volute shapes such as those having elliptical or rectangular plans or a truncated cone shape are also suitable for use in the present invention.

Figure 2:
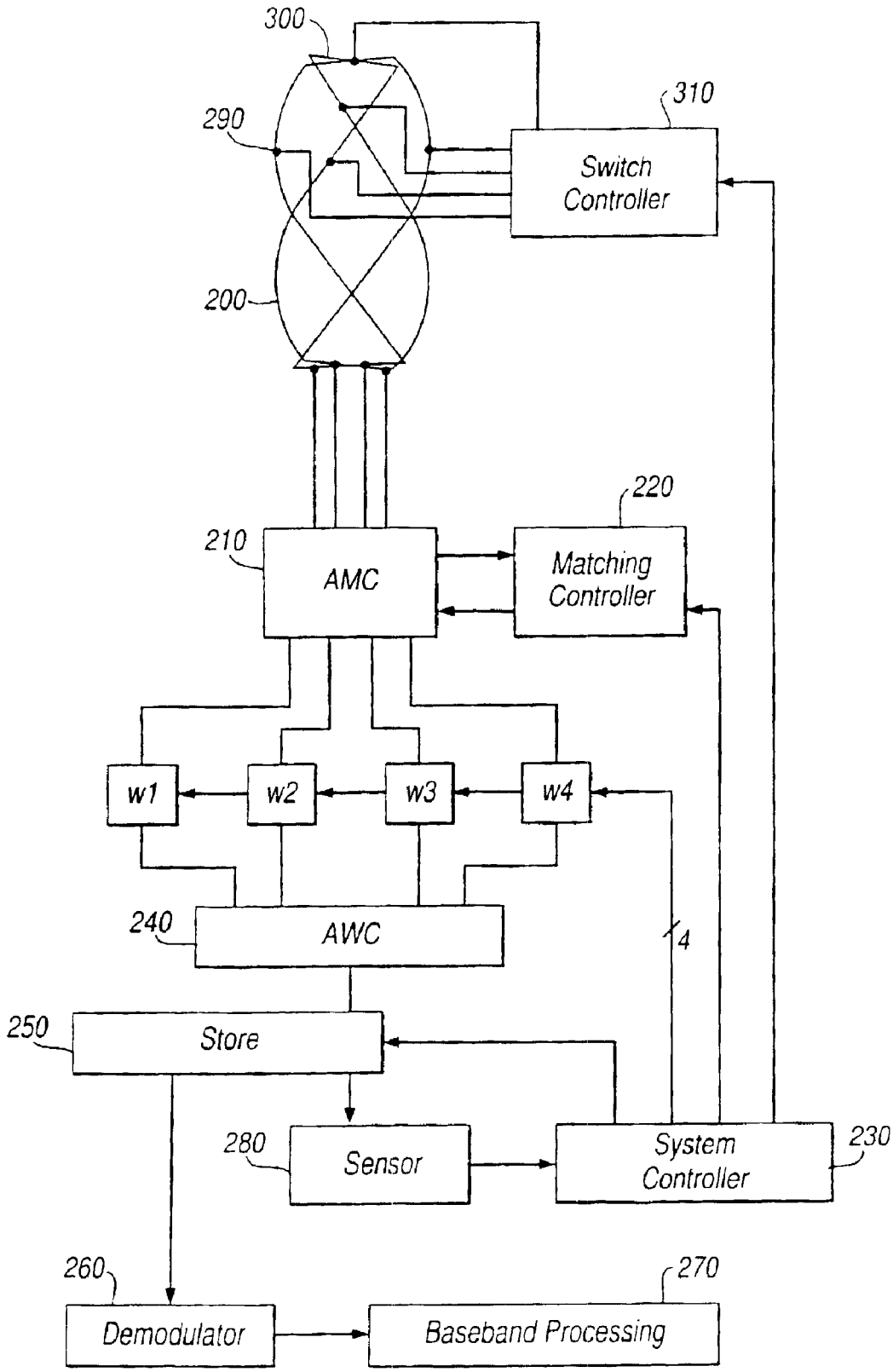
FIG. 2 is a schematic diagram of an antenna interface circuit.

FIG. 2 is a schematic diagram of an antenna system comprising an adapted QHA 200 and an antenna interface circuit.

In FIG. 2, the four elements of the QHA 200 are connected separately to an adaptive matching circuit 210. (In the configuration shown in FIG. 2, the antenna is in a receive mode, but it will be clear that signals could instead be supplied to the antenna, in a transmit mode, by reversing the direction of signal propagation arrows in FIG. 2.) The adaptive matching circuit 210 is under the control of a matching controller 220, which in turn is respective to a system controller 230.

Received signals from the adaptive matching circuit are supplied to four respective variable weighting circuits W1 . . . W4. Each of W1 . . . W4 comprises a variable phase delay and optionally, a variable gain stage, all controllable by the system controller 230.

An alternative which is described in more detail below is to combine diametrically opposite pairs of elements (10, 30 and 20, 40) with fixed 180° weights at RF so that the antenna has only two feeds (each relating to a respective diametric pair) and therefore requires only two weighting circuits W1, W2 and two transceivers 400 and 450.

In the embodiment of FIG. 2, the outputs of the four variable weighting elements W1 . . . W4 are combined by an adder/weight combiner 240 to form a composite signal. This composite signal is then stored in a store 250. A sensor 280 examines the signal (e.g. the level of the signal to (noise plus interference) ratio) and passes, this information to the controller which in turn adjusts the weighting factors of the weighting elements W1 . . . W4, the matching circuit 210 and the switch elements 290, 300 to improve or possibly optimise the parameter sensed by the sensor 280. The optimisation information can be used to optimise or improve the quality of the stored signal, which is then passed to the demodulator 260. The information is also used to adjust the antenna system to receive the next incoming signal.

In each element of the QHA, there is a switch 290 capable of isolating a portion of the element remote from the feed point. The switch could be, for example, a PIN diode switch. Similarly, a switch 300 is capable of shorting or isolating pairs of the elements at the end remote from the feed point.

The operations performed by the switches 290 and 300, under the control of a switch controller 310, can change the response and radiation pattern of the antenna. In particular, by isolating a section of each element, the electrical length of the elements is made shorter and so the frequency of operation will be higher. Again, these operations are carried out under the control of the system controller to improve or possibly optimise operation with a particular signal frequency, polarisation and direction of propagation.

Alternatively, or additionally, the antenna element may be caused to have several resonant modes by the inclusion of one or more antenna traps. This causes the antenna to be resonant (and therefore have increased gain) at more than one operating frequency.

Figure 3:
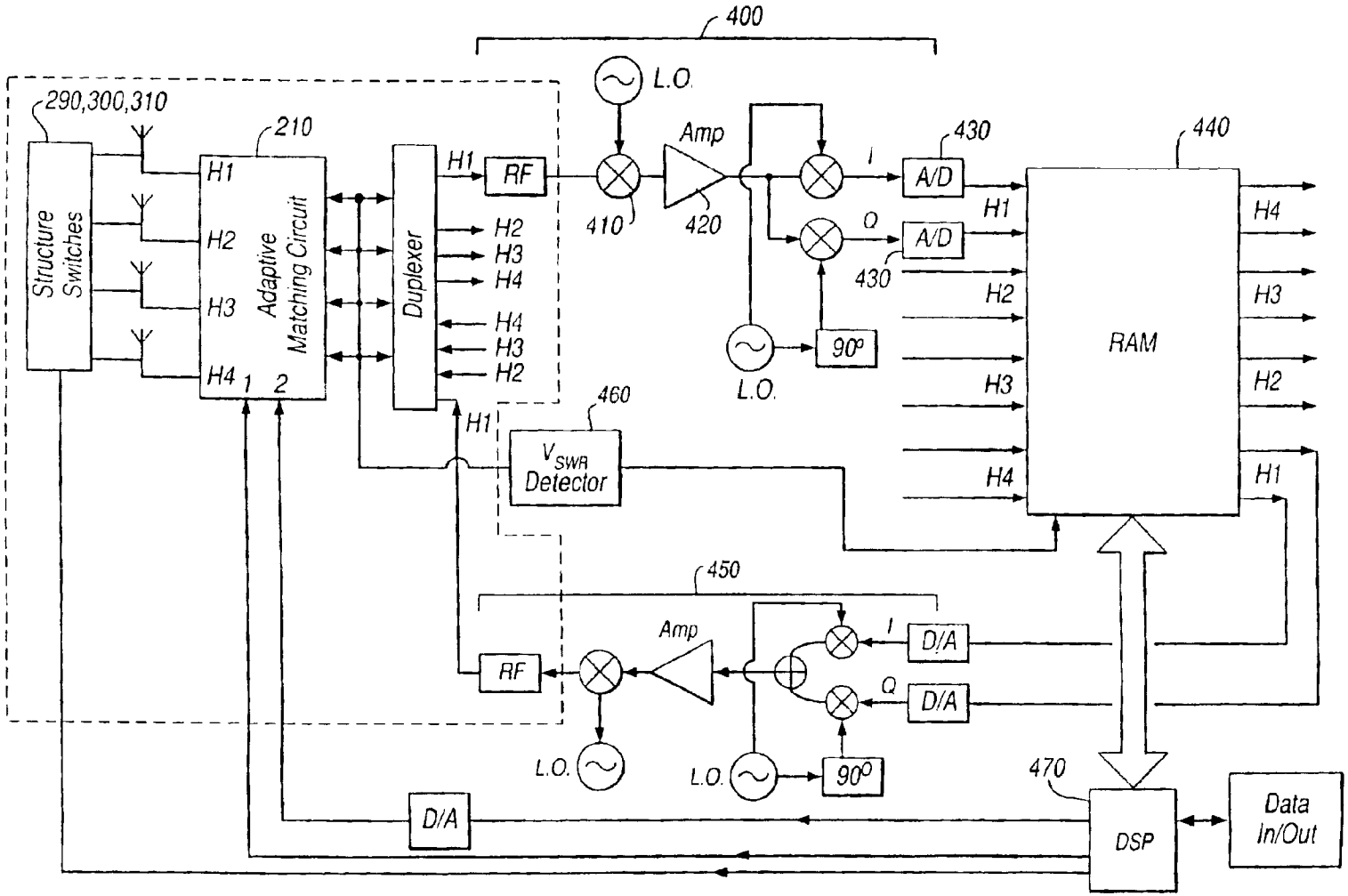
FIG. 3 is a more detailed schematic diagram of one possible implementation of the antenna system of FIG. 2.

FIG. 3 is a more detailed schematic diagram of one possible implementation of the antenna system of FIG. 2, which also shows operation to improve or optimise the VSWR during a transmission operation and S/N+I during a receive mode. (Incidentally, when S/N+I is improved by adapting the antenna matching in a receive mode, this has an indirect side-effect of tending to improve the VSWR. Also, when the pattern mode, polarisation and direction are improved by adjusting for the best or an improved S/N+I, this similarly has a corresponding improving effect in a transmit mode.)

In FIG. 3, the operation of the weighting elements W1 . . . W4 is carried out at baseband in a digital domain, as is the operation of the adder/weight combiner 240.

The output of the adaptive matching circuit 210 is supplied to a quadrature downconverter 400 comprising an intermediate stage 410 where a local oscillator signal is mixed with the radio frequency signal, an amplifier 420 and a further stage of mixing with a local oscillator signal with a 0° and 90° phase relationship to generate two demodulated outputs I and Q. These are both converted to digital representations by A/D converters 430 before being stored in a RAM 440. This process is replicated for each of the elements of the QHA. Similarly, for the transmit side, an output from the RAM 440 is passed to a quadrature modulator 450 before being routed via the adaptive matching circuit 210 to the respective antenna elements. A VSWR detector 460 operates in a transmit and/or receive mode to detect the standing wave ratio of the antennas. The output of this is stored in the RAM 440.

The RAM is connected to a digital signal processing (DSP) unit 470 which combines the digital representations of the signals stored in the RAM 440 in respective proportions and using respective phases (i.e. performs the operation of the weighting blocks W1 . . . W4), detects and optimises the selected parameter such as signal-to-noise ratio, sends control signals to the adaptive matching circuits to change from one frequency band to another or to overcome de-tuning effects, and also controls the switch controller 310 and in turn the switches 290, 300 within the helical elements.

One appropriate DSP algorithm is for the transmitter to send packet header, reference or training symbols, which are known to the receiver. Any disturbance to the received signals during the reception of the training symbols is a measure of N+I and can be reduced by trial and error (repeated combining of the digital representations stored in the RAM 440), direct matrix inversion of the associated correlation matrix or by iteration approaches such as so-called LMS or RLS algorithms. However, even if known training symbols are not available, a measure of the disturbance to the signal can be made by error detection algorithms applied to the received symbols.

Figure 4:
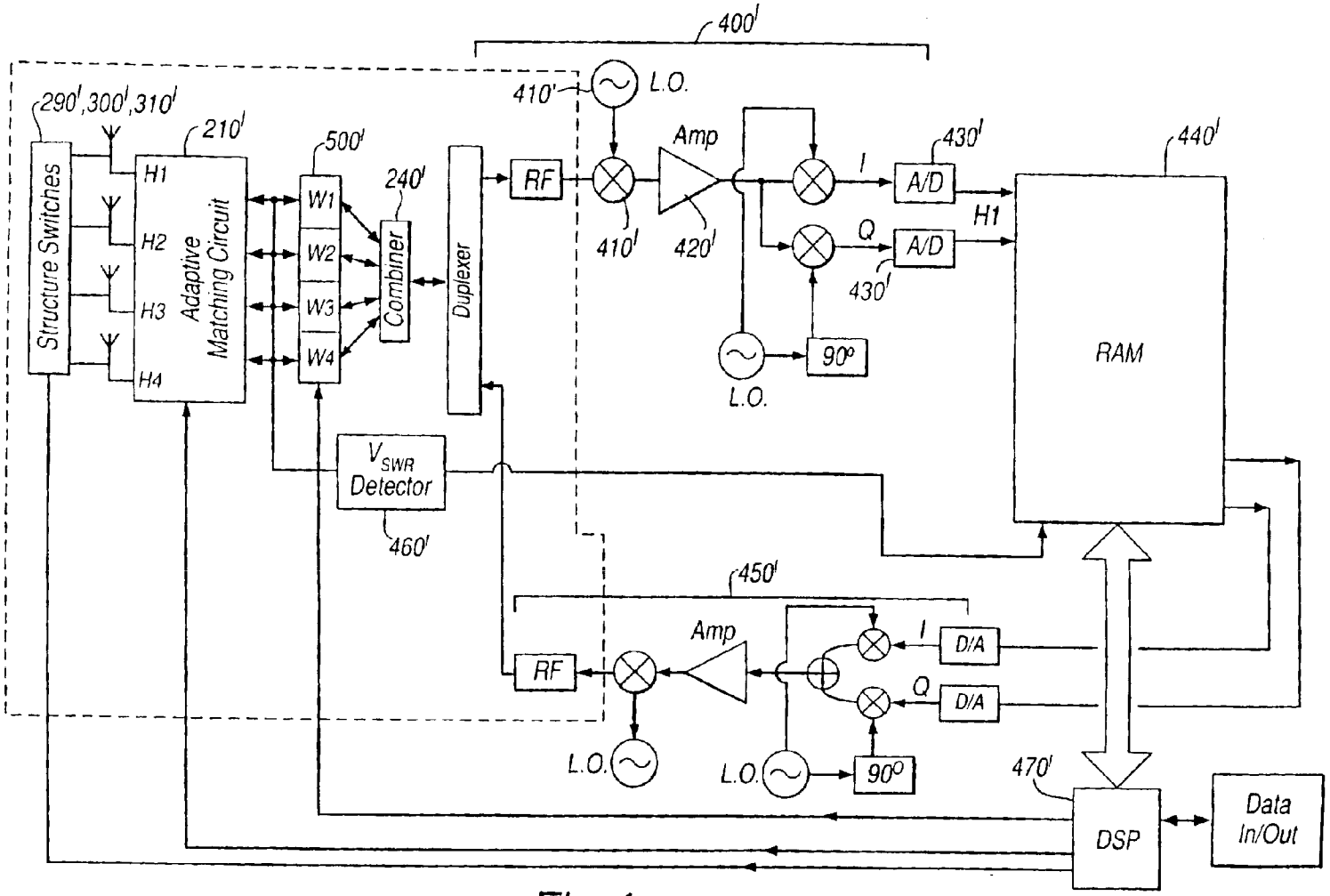
FIG. 4 is a more detailed schematic diagram of another possible implementation of the antenna system of FIG. 2.

FIG. 4 is a more detailed schematic diagram of an alternative implementation of the antenna system of FIG. 2. This implementation has a quadrature downconverter 400' which operates in the same way as the downconverter 400 of FIG. 3. Similarly, it has a quadrature modulator 450' which operates in the same way as the modulator 450 of FIG. 3.

The operation at baseband of the implementation shown in FIG. 4 is also similar to that of FIG. 3 in that the downconverted signals are converted into the digital domain and stored in a RAM 440'. The data in the RAM is processed by a digital signal processing unit 470' and the DSP 470' is operable to cause changes in the adaptive matching circuit 210' and in the antenna switches 290', 300' and 310'.

However, the operation of a circuit of FIG. 4 differs significantly from that of FIG. 3 in that the weighting operation is performed at RF in weighting blocks 500 which are coupled in the signal path from the individual antenna elements to the quadrature downconverter 400'.

In FIG. 4, the weighting block 500 is coupled directly between the adaptive matching circuit 210' and a combiner 240' which operates to additively combine the outputs of the respective weighting circuits W1, W2, W3, W4 contained in the weighting block 500.

The output of the combiner 240' is fed into a single quadrature downconverter 400'. Thus, unlike the implementation shown in FIG. 3, only one downconverter 400' is required. Similarly, only one quadrature modulator 450' is required.

This alternative implementation has two main advantages. Firstly, since only one downconverter 400' and one modulator 450' is required, there is a resultant cost saving in the manufacture of the transceiver.

Secondly, since most of the noise in the received signal is introduced by the receiver, there is a fourfold decrease in the noise added by the receiver section since the signal passes through only one (instead of four) downconverters 400'. As a further subsidiary advantage, since the signal from all four antenna elements is subjected to the same noise in the single downconverter 400', it is not necessary to apply gain weightings. Thus the weighting circuits W1, W2, W3, W4 may be arranged only to apply phase adjustments to the signals received by the antenna elements. This simplifies their construction and therefore also has cost and reliability advantages.

In order to optimise the weightings, a slightly different approach may be taken to that used with the implementation of FIG. 3. It will be noted that in the implementation of FIG. 3, the stored data may be iteratively processed with different weighting applied to the data until an optimal or at least improved result is obtained. However, in the implementation of FIG. 4, the data stored in the RAM 440' already has weighting applied to it and in fact the signals from each of the elements of the antenna have already been combined by the combiner 240'. Thus, in order to find the correct weighting, the weighting are adjusted dynamically during reception of a signal (for example a training sequence). By storing data representing the known weighting settings against data representing the quality of the received signal, it is possible to determine which weighting gives the best reception and/or transmission characteristics. Thus the principles are similar but in the first case (FIG. 3) the weighting optimisation may occur "off line" whereas in the implementation of FIG. 4, the weighting optimisation occurs "on line" during reception of a signal.

As mentioned above, the number of weighting blocks (and in the case of the embodiment shown in FIG. 3, of up and down converters) may be reduced by coupling together predetermined antenna elements. This has the advantage of reducing further the complexity of the circuit and therefore its cost.

In the preferred embodiment using a quadrifilar helical antenna as shown in FIG. 1, the predetermined groups of antennas are two groups containing the diametrically opposite pairs of elements 10, 30 and 20, 40 respectively.

The Table below shows the diversity correlation coefficient matrix for each of the elements. The figures have been derived from complex coefficients produced empirically. It will be noted that in the table below, the diametrically opposite pairs of elements have correlation coefficients in excess of 0.7.

TABLE 1

Diversity parameters for four elements of the QHA

| Correlation coefficient matrix | Element 10 | Element 20 | Element 30 | Element 40 |
|---|---|---|---|---|
| Element 10 | 1.00 | 0.13 | 0.75 | 0.14 |
| Element 20 | 0.13 | 1.00 | 0.17 | 0.76 |
| Element 30 | 0.75 | 0.17 | 1.00 | 0.20 |
| Element 40 | 0.14 | 0.76 | 0.20 | 1.00 |

Thus, although the grouping of elements is described below in connection with two pairs of elements, on a more general level, the predetermined groups of elements may be groups of elements which are each correlated to within 0.6, preferably 0.7 and more preferably 0.8 or better.

For the quadrifilar helical antenna described below, the pairs of elements are coupled in pairs with a 180° phase shift. This may be achieved using fixed combiners or baluns B1, B2 as shown in FIGS. 5 and 6.

Figure 5:
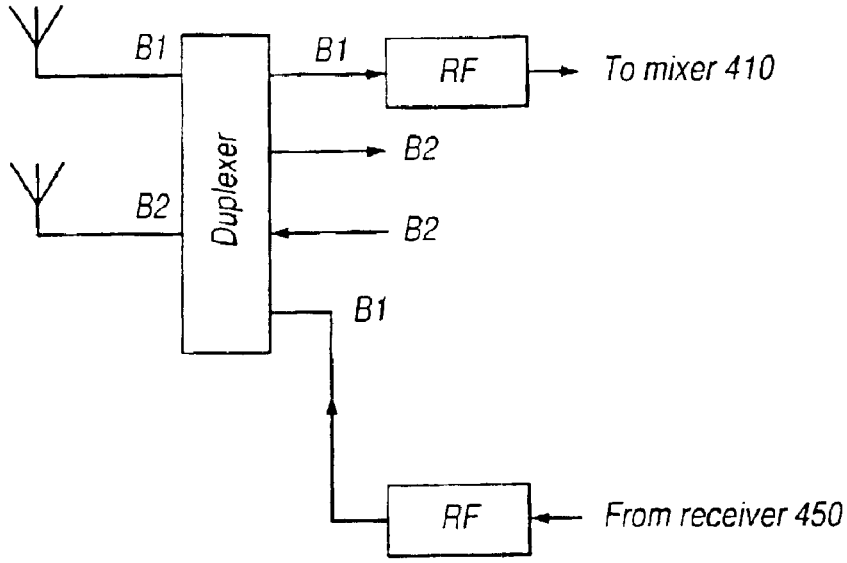
FIG. 5 is an enlarged view of an alternative for the portion of FIG. 3 enclosed in dotted lines.

Looking particularly at FIG. 5, it will be noted that the components shown in that Figure can be used to replace the components shown within the dotted outline on FIG. 3. This allows the circuit in FIG. 3 to only have two up and down converters 400, 450 which reduces cost. Although FIG. 5 does not show an adaptive matching circuit 210, this could be included.

Figure 6:
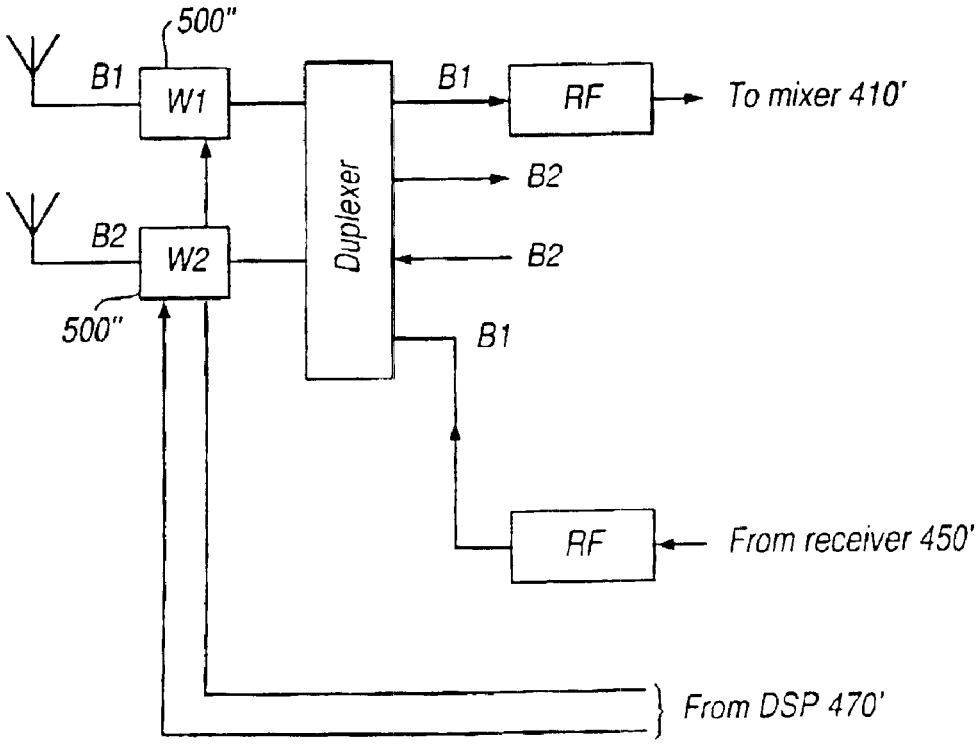
FIG. 6 is an enlarged view of an alternative for the portion of FIG. 4 enclosed in dotted lines.

FIG. 6 shows the equivalent modification for the circuit of FIG. 4. Similarly, the adaptation of FIG. 6 could include an adaptive matching circuit 210'.

The circuits of FIGS. 5 and 6 could also include provision for structure switches 290, 300 or 290', 300' respectively.

The grouping of elements in this way may produce a slightly reduced diversity gain compared to the earlier described circuit in which all four elements are independently adjusted.

Figure 7:
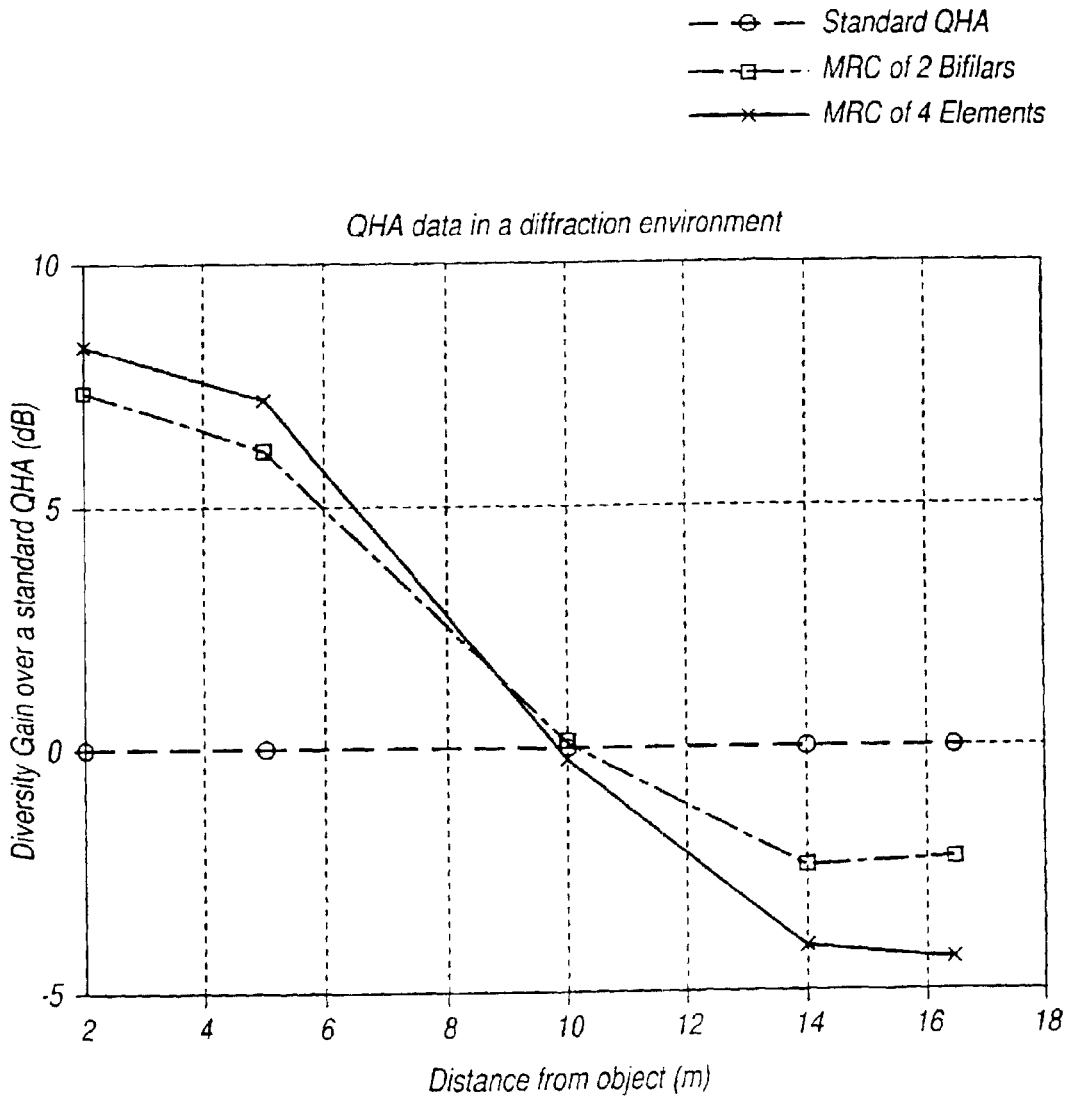
FIG. 7 is a plot comparing the diversity performance of differently configured QHAs.

However, FIG. 7 shows a comparison of the performance of a QHA having four independently adjusted elements and a QHA in which the elements are combined into two pairs, against a standard QHA (which has been normalised to the 0 dB level). It will be seen that the diversity gain penalty for using the grouped configuration is only about 1 dB in areas of deep shadow with high multipath and that there is an advantage in situations where the signal is not significantly decorrelated between elements (for example, in environments where there is a direct line of sight between the base station transceiver and the antenna).

Thus it will be seen that the optimal solution will usually be separate control of each element 10 . . . 40. However, a very satisfactory compromise may be reached between cost and performance by carefully selecting elements (for example according to their diversity correlation coefficient, however measured) and combining these elements with suitable fixed phase shifts to provide a reduced number of antenna feeds.

What is claimed is:

1. An adaptive multifilar antenna comprising:

a plurality of spaced filaments, at least a portion of the filaments being coupled together in a fixed phase relationship to form a group of filaments;

a weighting circuit operable to apply variable phase adjustments to signals passed to and/or from the filaments, said weighting circuit being operable to apply a common variable phase adjustment to signals passed to and/or from the filaments of the group;

detecting means operable to detect at least one electrical property of the adaptive multifilar antenna with respect to at least one of the frequency, polarization and/or direction of propagation of a signal to be received or transmitted by the adaptive multifilar antenna and impedance matching of the antenna; and control means, responsive to the detecting means, operable to control operation of the weighting circuit to adjust properties of the multifilar antenna to suit better a current signal to be received or transmitted.

2. The antenna according to claim 1, wherein the weighting circuit is operable to apply gain adjustments to signals passed to and/or from the filaments and to apply the same gain adjustment to signals passed to and/or from the filaments of the group.

3. The antenna according to claim 1, including switch means associated with the filaments for selectively altering the electrical length and/or interconnections of the filaments, the signal connections to/from the filaments being at a first end of each filament; and the switch means being operable to selectively interconnect pairs of filaments, a second end of those filaments being remote from the first end.

4. The antenna according to claim 1, in which there are 4 or 6 said filaments.

5. The antenna according to claim 1, including switchable filaments having switch means for selectively altering the electrical length and/or interconnections of the switchable filaments and each of the switchable filaments including at least a first filament section and a second filament section; and the switch means being operable to selectively connect or isolate the first and second filament sections of each switchable filament so as to vary the electrical length of that filament.

6. The antenna according to claim 1, including a matching circuit for matching the characteristic impedance of the antenna to that of a transmitting and/or receiving apparatus.

7. The antenna according to claim 6, wherein the control means is operable to control the operation of the matching circuit to adjust the properties of the adaptive multifilar antenna to suit better a current signal to be received or transmitted.

8. The antenna according to claim 6, in which:

the detecting means is operable to detect a signal to noise ratio of a received signal; and the control means is operable to control the operation of the matching circuit and/or the weighting circuit so as to improve the signal to noise ratio of the received signal.

9. The antenna according to claim 6, in which:

the detecting means is operable to detect a signal to (noise plus interference) ratio of a received signal; and the control means is operable to control the operation of the matching circuit and/or the weighting circuit so as to improve the signal to (noise plus interference) ratio of the received signal.

10. The antenna according to claim 6, in which:

the detecting means is operable to detect a signal level of a received signal; and the control means is operable to control the operation of the matching circuit and/or the weighting circuit so as to improve the signal level of the received signal.

11. The antenna according to claim 6, in which:

the detecting means is operable to detect a VSWR for a transmitted signal; and the control means is operable to control the operation of the matching circuit and/or the weighting circuit so as to improve the VSWR for transmission of that signal.

12. The antenna according to claim 1, in which the detecting means comprises:

analogue to digital conversion means for converting respective signals received by the filaments into corresponding digital representations;

a memory for storing the digital representations;

means for combining the digital representations using respective phase relationships and gains; and means for detecting properties of the antenna by analysis of the combined digital representations.

13. The antenna according to claim 1, in which the detecting means comprises:

means for combining respective signals received by the filaments;

analogue to digital conversion means for converting the combined signals into a corresponding digital representation;

a memory for storing the digital representation; and means for detecting properties of the antenna by analysis of the combined digital representations.

14. The antenna according to claim 13, wherein the combining means is operable to combine the respective signals having respective gain weighting.

15. The antenna according to claim 1, in which the detecting means operates at least during reception of a reference signal burst by the antenna.

16. The antenna according to claim 1, in which there is an even number of said filaments.

17. The antenna according to claim 1, wherein there are 4 said filaments and including two filament groups each of two diametrically opposed filaments, the filaments in each respective group being coupled together with a relative phase weighting of substantially 180°.

18. The antenna according to claim 1 wherein the filaments in the group of filaments have a diversity correlation of 0.7 or better.

19. The antenna according to claim 1, in which the filaments are helically shaped.

20. The antenna according to claim 1, in which the filaments are at least partially intertwined.

21. The antenna according to claim 1, having a volute of generally elliptical or rectangular axial cross-section.

22. The antenna according to claim 21, wherein the respective outputs of the weighting circuit are combined prior to frequency downconversion.

23. The antenna according to claim 1, wherein the weighting circuit operates at baseband.

24. The antenna according to claim 1, wherein the weighting circuit operates at RF.

* * * * *